United States Patent [19]

Lautenschläger

[11] 4,359,803

[45] Nov. 23, 1982

[54] HINGE FOR CABINET DOOR MIRROR

[75] Inventor: Karl Lautenschläger, Reinheim, Fed. Rep. of Germany

[73] Assignee: Karl Lautenschläger KG, Möbelbeschlagfabrik, Reinheim, Fed. Rep. of Germany

[21] Appl. No.: 224,690

[22] Filed: Jan. 13, 1981

[30] Foreign Application Priority Data

Jan. 17, 1980 [DE] Fed. Rep. of Germany ..... 3001559

[51] Int. Cl.[3] ..... E05D 11/10; E05D 7/12

[52] U.S. Cl. ..... 16/272; 16/249; 16/335; 16/382

[58] Field of Search ..... 16/296, 294, 302, 335, 16/271, 272, 366, 382, 249

[56] References Cited

U.S. PATENT DOCUMENTS 3,590,420 7/1971 Salice ..... 16/335
4,184,228 1/1980 Lautenschlager et al. ..... 16/335

FOREIGN PATENT DOCUMENTS 1904781 8/1970 Fed. Rep. of Germany .
2912813 10/1980 Fed. Rep. of Germany .

*Primary Examiner*—Werner H. Schroeder
*Assistant Examiner*—Andrew M. Falik

[57] ABSTRACT

An over-center hinge for thin doors of cabinets, especially those of bathroom mirrored cabinets, having a thin door-related part which can be fastened in a mating recess provided on the inside of the door and open at the door edge. The door-related hinge part is divided into an outer mounting plate which can be fastened in the recess of the door and is likewise open at the end adjacent the open door edge, and a separate link holder which can be inserted into the mounting plate from the open edge, on which link holder the supporting arm fastenable to a supporting wall of the cabinet is pivotingly articulated. A cap mounting projection extending from the inside of the door, to which projection there is removably fastened a molded cap which bears a tongue extends into the path of a contact surface provided on the supporting arm and is resiliently compressible by this contact surface against a spring force. The link holder engages with lateral projections in grooves of the mounting plate which extend in the inserting direction and open in the open end of the mounting plate, and fastening elements securing the link holder against withdrawal from the mounting plate.

12 Claims, 16 Drawing Figures

HINGE FOR CABINET DOOR MIRROR

BACKGROUND

The invention relates to an over-center hinge for thin doors of cabinets, especially bathroom mirror cabinets.

Such an over-center hinge has already been proposed (German Offenlegungsschrift No. 2,912,813). It has a flat door-related part articulated to a supporting arm that can be fastened to the supporting walls of the cabinet. The door-related part is susceptible of fastening, preferably by cementing, in a mating recess provided in the inside of the door and open at the edge of the door, and which has a cap mounting projection protruding from the inside of the door. To this projection a molded cap is removably fastened which bears a tongue which is resiliently displaceable against spring force and extends into the path of a contact surface provided on the hinge arm. The contact surface glides on the tongue during a part of the closing movement through a dead-center position on one side of which the tongue exerts on the contact surface of the supporting arm a force acting in the hinge opening direction and on the other side of which it exerts a force acting in the hinge closing direction.

This older hinge, which has proven both functional and reliable, is fastened to the door by cementing its door-related part in a shallow recess in the back of the mirrored door, i.e., by a method which does not allow non-destructive removal. This leads to problems if the mirror doors provided with the hinge are not to be mounted on a corresponding cabinet immediately after cementing, but must first be stored or shipped, because—as is the case in practice—the manufacturer specializing in the production of mirror doors does not equip the mirror doors with the hinges installed in his own plant, but instead delivers the doors and the hinges to manufacturers specializing in the production of the body of mirrored bathroom cabinets, for example. The delicate mirror glass doors must then be put together in bundles for shipment. However, bundling is complicated by the hinges cemented unremovably to the mirror doors, and particularly on account of the linkage mechanism projecting beyond the door from the door-related part of the hinge, and also by the supporting arm of the hinges which is to be fastened to the cabinet carcass. For the solution of this packing and shipping problem, it would be desirable if the hinges or at least their bulky parts which project beyond the profile of the mirror door could be made removable from the door. In the case of conventional hinges for wooden cabinet doors, many different designs are known for constructing the door-related part of a hinge such that it can be applied to the door and removed therefrom quickly and simply, so that, among other things, the doors can be bundled together for shipment more easily due to the possibility of removing the hinges. One of the design possibilities that is utilized is the division of the door-related part of the hinge into an external mounting part to be permanently attached to the door, and a link holder which is easily removable from this mounting part. Reference is made in this connection, by way of example, to DE-AS No. 1,559,940, DE-OS No. 1,559,900 and DE-OS No. 1,904,781 as well as DE-OS No. 2,143,672, which relate to furniture hinges with two-part door-related hinge parts.

In the case of the mirror cabinet doors with which the invention is concerned, the division of the already very shallow door-related member into two pieces which can be separated or joined together at will is much more difficult to design than in the case of the known hinges, inasmuch as mirror cabinet doors, in spite of their lesser thickness in comparison with wood doors, have a great weight, which would necessitate a strong joining together of the two parts of the door-related member.

It is therefore the object of the invention to improve the above-mentioned older mirrored cabinet over-center hinge such that the difficulties explained above in regard to packing and shipment of mirrored cabinet doors provided with pre-installed hinges will be eliminated.

BRIEF SUMMARY OF THE INVENTION

This object is achieved in accordance with the invention by dividing the door-related part of the hinge into an outer mounting plate which can be fastened in the recess of the door and which, like the recess in the door, is open at the end adjacent the edge of the door, and a separately made link holder which can be inserted into the mounting plate at the open end of the latter, and to which the supporting arm is articulated. The link holder has lateral projections engaging grooves which are provided in the mounting plate, extend in the direction of insertion from the open end of the mounting plate, and by providing releasable fastening means which positively secure the link holder in its properly installed position against removal from the mounting plate in the direction opposite that of its insertion. The link holder is attached to the mounting plate therefore by lateral insertion, it being thereby possible to make the door-related part of the hinge in two parts without increasing its overall dimensions, while nevertheless providing the required high load carrying capacity.

BRIEF DESCRIPTION OF THE DRAWINGS

The invention is further explained in the following description of two of its embodiments, with reference to the drawing, wherein.

DETAILED DESCRIPTION OF PREFERRED EMBODIMENTS

Figure 1:
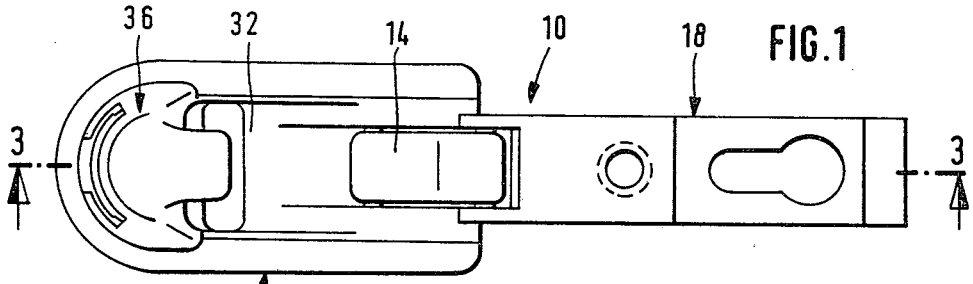
FIGS. 1 and 2 are a top plan view and a side elevational view of a first embodiment of the over-center hinge of the invention for mirrored cabinet doors.
Figure 2:
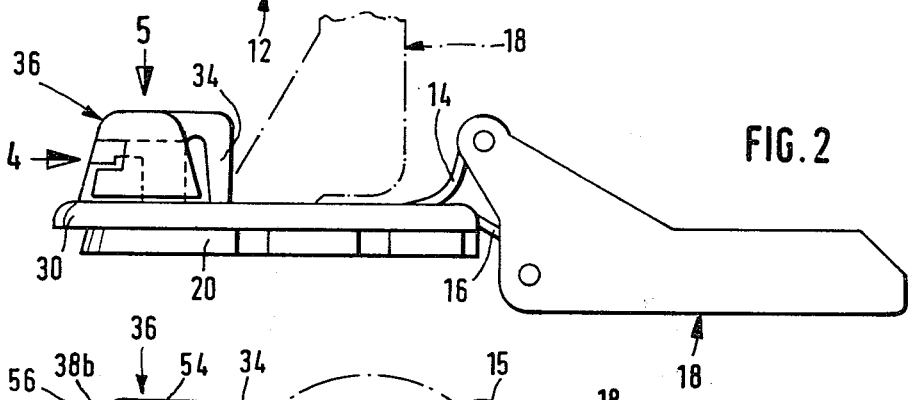
Figure 3:
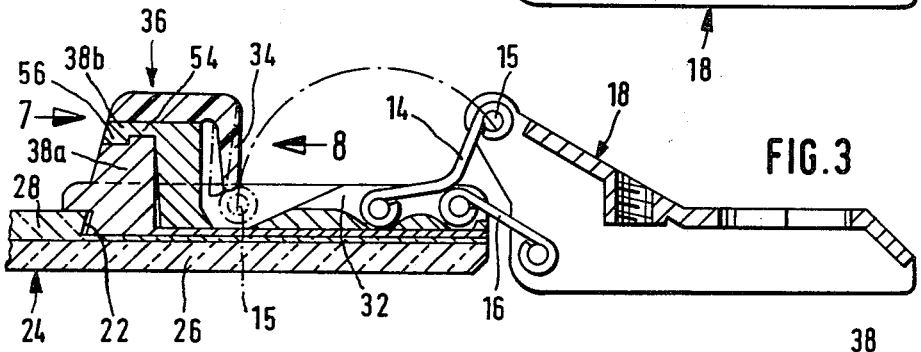
FIG. 3 is a cross section taken along line 3—3 of FIG. 1.

The hinge of the invention, which is generally designated by 10 in FIGS. 1 to 3, has a door-related hinge part 12 which is connected by two links 14 and 16 pivoted thereon to a supporting arm 18 on which the links 14 and 16 are also pivoted. The supporting arm 18 is, in a known manner, adjustably fastenable to a mounting plate, not shown, which is to be disposed on a supporting wall of the piece of furniture, for example the side wall of a mirrored cabinet.

The door-related hinge part 12, which is elongated in plan and rounded on the end opposite the supporting arm, is, as best seen in FIGS. 2 and 3, of very shallow configuration and has a bottom root section 20, accounting for about half its thickness, which can be inserted into a mating recess 22 in a thin door leaf 24 (FIG. 3), such as for example a mirrored cabinet door. The door leaf 24, in whose recess 22 the root section 20 can be cemented, for example, is composed in the illustrated case of an outer plate 26 consisting of mirror glass, and an inner backing plate 28 which is connected to the mirror and which, if desired, can also be a plate of mirror glass disposed with its back against the outer mirror glass plate. In any case, the recess 22 intended for the mounting of the root section 20 of the door-related hinge part is formed in this backing plate. The door-related hinge part 12 extends in a flange-like manner beyond the root section 20. This flange-like lip, which conceals the gap between the root section 20 and the edge of the recess, surrounds the root section with the exception of its edge opposite the supporting arm 18. This edge is approximately flush with the edge of the door, so that the recess 22, therefore, is open at its edge facing the supporting arm.

Figure 9:
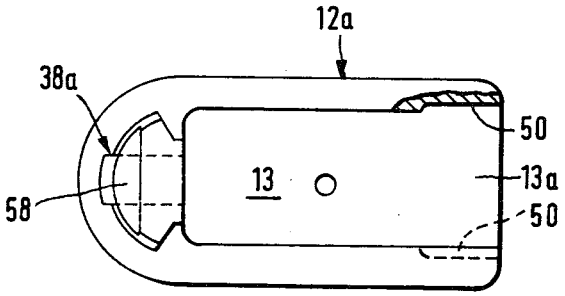
FIG. 9 is a partially cut-away plan view of the mounting plate of the hinge shown in FIGS. 1 to 3.

The door-related hinge part is composed, in the manner to be further explained hereinafter in conjunction with FIGS. 9 and 10, of an outer mounting plate **12*a* and an inner link holder 12*b* releasably inserted in the mounting plate 12*a*. In the inner link holder 12*b* there is formed a recess 32 open toward the viewer of FIG. 1. The ends of the links 14 and 15, bent around to form eyes, are mounted on pins within the recess 32 adjacent the supporting arm 18. The area of recess 32 remote from the supporting arm 18 serves for the accommodation of a projecting section of the supporting arm when the hinge is in the closed state. The position of the supporting arm 18 in this closed state is represented in FIG. 2 additionally by a broken outline of its front end, it being apparent that in this position the projecting section of the supporting arm, and with it the pivot eye 15 of link 14, lies within the recess 32. The position of this eye when the hinge is closed is also represented in broken lines in FIG. 3**.

Figure 4:
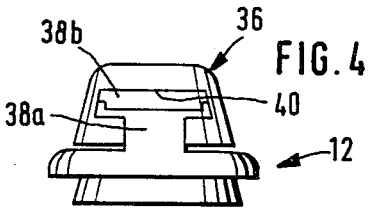
FIG. 4 is a view of the hinge shown in FIGS. 1 to 3, as seen in the direction of arrow 4 in FIG. 2.
Figure 5:
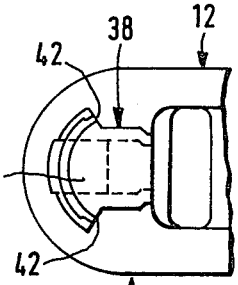
FIG. 5 is a partial plan view of the door-related part of the hinge of the invention, as seen in the direction of arrow 5 in FIG. 2, but without the molded cap forming part of the over-center mechanism.
Figure 7:
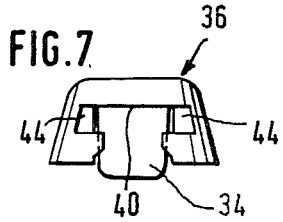
FIG. 7 is a view of the molded cap as seen in the direction indicated by arrow 7 in FIG. 3.
Figure 8:
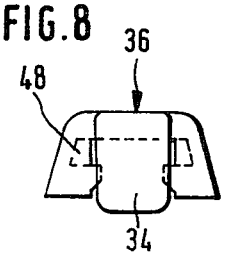
FIG. 8 is a view of the molded cap seen in the direction of arrow 8 of FIG. 3.
Figure 6:
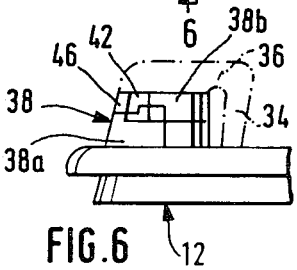
FIG. 6 is a view seen in the direction of arrow 6 in FIG. 5.

The over-center mechanism of the hinge 10 is formed by a resiliently deformable tongue 34 cooperating with the eye 15 of the link 14; this tongue is formed integrally on the upper end of a molded cap 36 by the injection molding process, from a plastic having the required resilient characteristics, and it is inclined in the manner best seen in FIG. 3, so that its free extremity is within the recess 32. The molded cap 36, whose back is rounded to complement the rounding of the door-related hinge part 12, is fastened on a cap mounting projection 38 of T-shaped cross section as seen in FIG. 4, which projects from the door-related hinge part 12, and which is composed in the present case (FIGS. 3, 5, 6, 8 and 9) of two parts **38*a* and 38*b*, each cast integrally on the mounting part 12*a* and on the link holder 12*b*, respectively, these being made of metal by the die-casting method. The cap 36 (FIGS. 7 and 8) in turn has on its bottom confronting the door-related hinge part 12 and on its side facing away from the tongue 34, an open recess 40 of complementary T shape, so that its installation on and removal from the door-related hinge part can be accomplished quickly and rapidly by pushing it on or pulling it off from the cap mounting projection 38 lengthwise of the hinge. In the properly fastened position, the cap 36 is fixed by abutments 42 and 44, which are formed, one by the transition surfaces between a widened portion 46 of the crossbar of the T-shaped cap mounting projection 38 and the other by corresponding transition surfaces in an associated wing 48 of the recess 40**, respectively.

Figure 10:
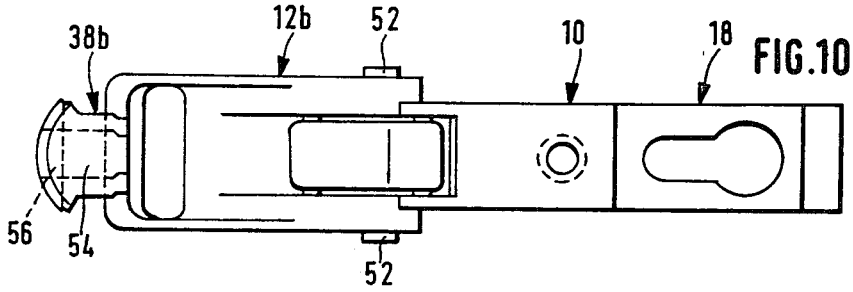
FIG. 10 is a plan view of the link holder which can be installed in the mounting plate of FIG. 9, with the supporting arm pivoted thereon.
Figure 11:
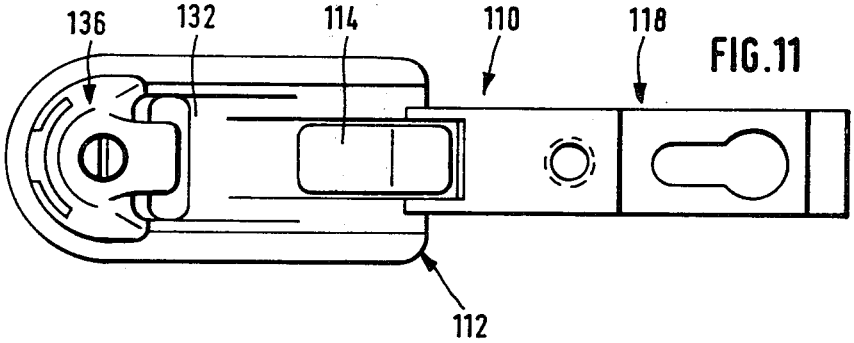
FIGS. 11 and 12 are a top plan view and a side view, respectively of a second embodiment of the over-center hinge of the invention for mirrored cabinet doors.
Figure 12:
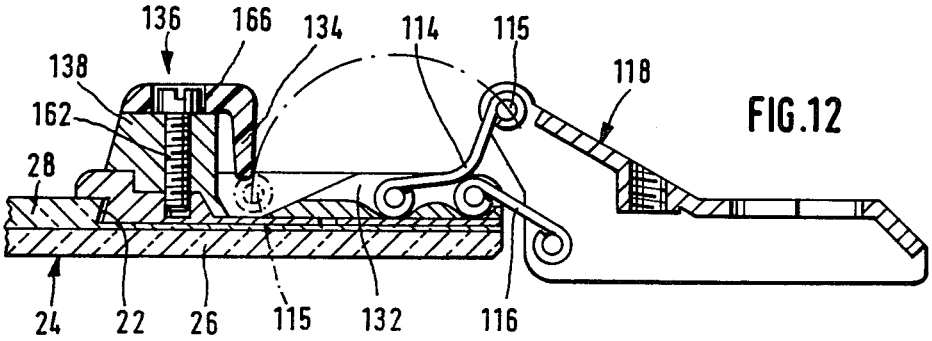
Figure 13:
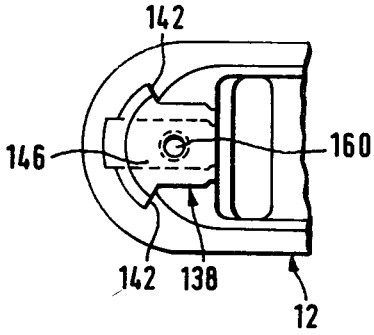
FIG. 13 is a fragmentary top plan view of the door-related part of the hinge shown in FIGS. 11 and 12, but without the molded cap forming part of the over-center mechanism.
Figure 14:
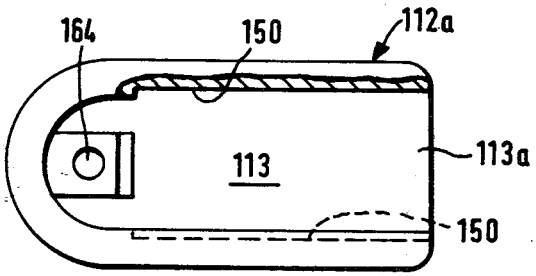
FIG. 14 is a partially cut-away plan view of the mounting plate of the hinge of FIGS. 11 and 12.
Figure 15:
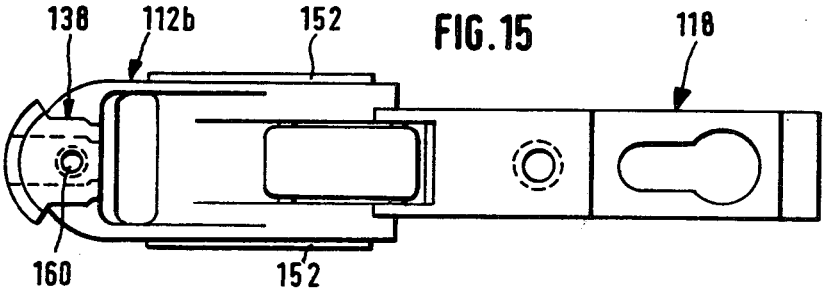
FIG. 15 is a top plan view of the link holder which can be inserted into the mounting plate of FIG. 14, including the hinge link and the supporting arm.
Figure 16:
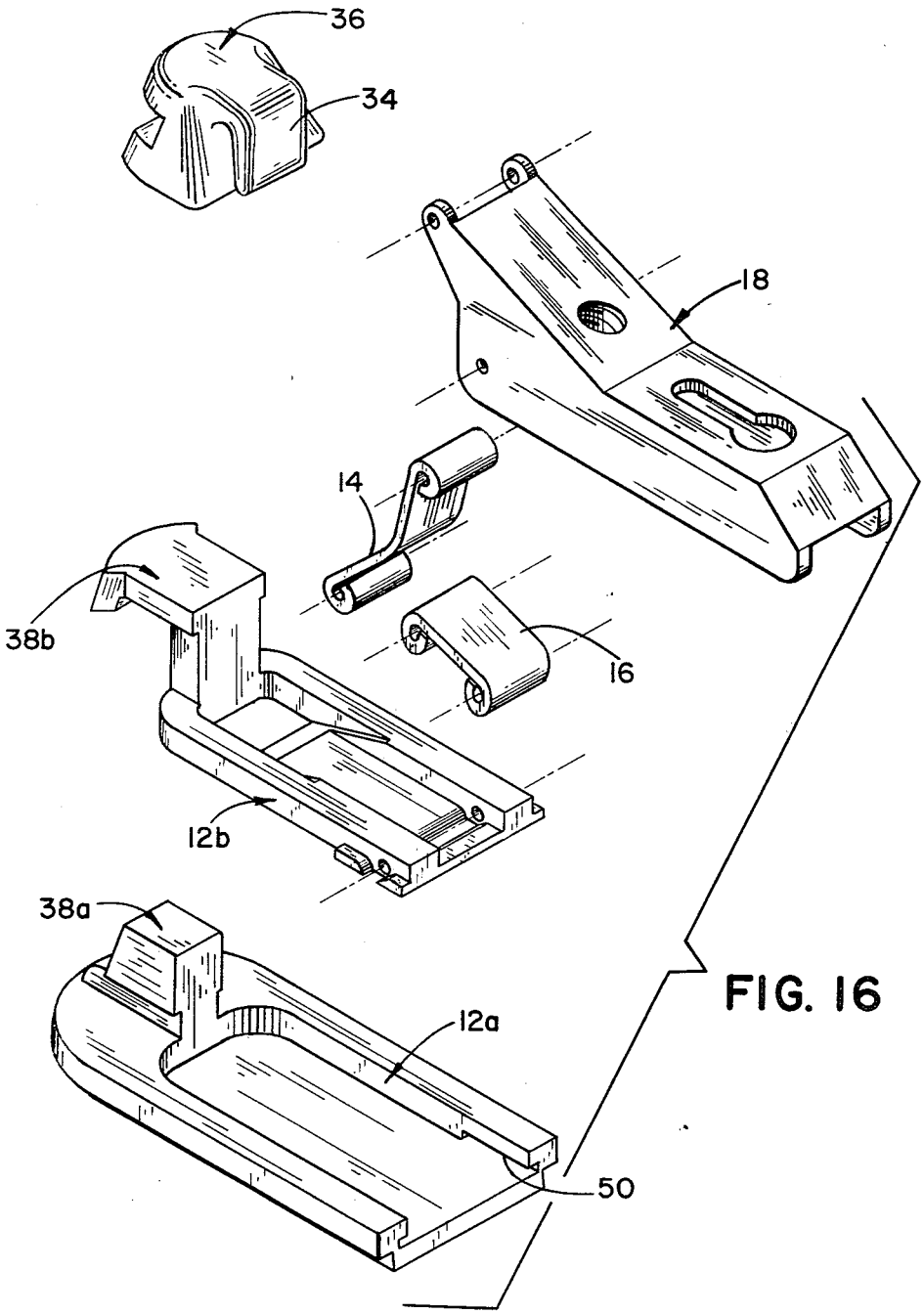
FIG. 16 is an isometric perspective view of various elements of the hinge of FIGS. 1 to 10.

The door-related hinge part 12 is composed, as mentioned above, of the outer mounting plate **12*a* (FIG. 9) which is to be permanently fastened by cementing in the recess 22 of the door leaf 24, and which has a recess 13 open at 13*a* at the end adjacent the door edge, and the link holder 12*b* which can be fitted into the recess 13 from the open end 13*a* (FIG. 10). In the lateral boundary walls of the recess 13, grooves 50 are created which are engaged by projections 52 laterally extending from the link holder 12*b*, when the link holder 12*b* is properly installed in the mounting plate 12*a*. These projections 52 can be, for example, in the form of short studs projecting from the link holder and having a diameter equal to the width of the corresponding groove 50. The projections 52 engaging groove 50 secure the link holder 12*b* against separation from the mounting plate 12*a* by separating forces acting at right angles to the inside surface of the door leaf 24. Instead of projections 52, the pin mounting the link 16 in the link holder 12*b* can also be prolonged such that it projects laterally from both sides of the link holder. The projecting ends of this pin then replace the projections 52**.

The securing of the link holder **12*b* against lengthwise withdrawal from the mounting part 12*a* however, is accomplished by the special configuration of the projection parts 38*a* and 38*b* of the mounting plate 12*a* and link holder 12*b*, respectively, which in the assembled state compose the cap mounting projection 38. For this purpose the projection part 38*b* integrally cast on the link holder 12*b* has a section 54 overlapping the lower projection part 38*a* of the mounting plate 12*a*, and on the bottom side of this section 54 facing the projection part 38*a*, there is provided an elongated, transversely disposed lip 56 which fits matingly into a rebate 58 in the projection part 38*a***.

In the assembly of the door-related part 12, the link holder **12*b* is pushed from the open end 13*a* into the mounting plate 12*a*, the front end, bearing the projection part 38*b* of the link holder 12*b*, being raised in the last part of the insertion movement by the amount of the height of the lip 56, so that the lip can pass over the top of the projection part 38*a*, until in the fully inserted state it projects beyond the corresponding rebate 58. Then the raised link holder end is lowered again, thereby causing the lip 56 to engage the rebate 58. Then, when the cap 36 bearing the resilient tongue 34 is pushed onto the cap mounting projection 38 thus formed, the link holder 12***b* will be joined to the mounting plate 12*a* such that it is secured against unintentional separation, i.e., the mounting plate 12*a* and the link holder 12i b now form the door-related hinge part 12.

As evident from the above, the molded cap, in the manner set forth in the older patent application, may be made so as to be pushed matingly, in the direction of the deformation of the tongue, onto the mounting projection of the door-related hinge part and the cap removed therefrom in the opposite direction, with the cap mounting projection having a T-shaped cross section in a plane perpendicular to the direction of the installation of the cap, and the cap having a complementary T-shaped opening on at least one side of the cap and open at its bottom. The fastening means securing the link holder in the mounting plate against withdrawal in the direction opposite its direction of insertion can be a fastener which can be brought into mating engagement with the mounting plate or the link holder, as the case may be.

The cap mounting projection can then be formed by two projection parts composing the cap mounting projection when the link holder is properly installed in the mounting plate, the one part being affixed to the mounting plate and the other to the link holder, the lock in the form of a lip engaging a rebate in the other projection part when in the properly installed state. The molded cap installed on the cap mounting projection then secures this sort of interlocking junction and conceals same.

In the preferred embodiment of the invention, the projection part disposed on the link holder then has a section overlapping the projection part on the mounting plate in the direction of insertion, and on the bottom of this overlapping section there is provided the lip engaging the rebate disposed in the projection part corresponding to the mounting plate.

When the link holder is installed on the mounting plate, it is necessary for the lip to be lifted up above the section of the projection part that is in front of the rebate if it is to be able to enter the rebate; therefore, the design is made such, in further development of the invention, that the grooves in the mounting plate which accommodate the studs of the link holder extend only a short distance from the open end of the mounting plate toward the interior of the mounting plate, and that the studs of the link holder are such that they enable the link holder end opposite the stud end to be lifted up by the thickness of the lip.

In an alternative embodiment of the hinge of the invention, the cap mounting projection as a whole is disposed on the link holder, and has a through bore from top to bottom into which a screw constituting the fastening means can be introduced, whose threaded length is such that its end protrudes from the bottom of the link holder when it is driven all the way in, a recess being provided in the area of the mounting plate opposite the threaded bore of the link holder and accommodating the threaded end of the screw protruding from the bottom of the link holder. In this case either the through bore in the cap mounting projection is provided with a female thread to match the thread of the screw, or the bore in the cap mounting projection is a smooth-walled through bore, in which case the recess in the mounting plate is provided with a feamle thread to match the thread of the screw. In both cases, the fixation of the link holder in the mounting plate in thus accomplished by the screw, which merely has to be withdrawn by the amount by which it protrudes from the bottom of the link holder in order to release the two parts from one another.

The bore in the cap mounting projection is best provided at its top with a countersink to accommodate the head of the screw, so as to enable the molded cap to be pushed on after the link holder has been installed in the mounting plate.

On the other hand, such a countersink does not have to be provided if the molded cap has a through bore aligning with the through bore in the cap mounting projection and having a diameter at least equal to the diameter of the head of the screw, since the screw can then be driven in afterwards, i.e., after the molded cap has been pushed into place.

In FIGS. 11 to 15, which represent the above-mentioned alternative embodiment of an over-center hinge 110 for mirrored cabinet doors, parts which are the same as those of hinge 10 are provided with the same reference numbers prefixed with a 1. It is therefore sufficient hereinafter to explain the modifications made in the previously described example, while the description given above in conjunction with hinge 10 can be consulted with regard to the parts which have not been modified.

In hinge 110, the door-related part 112 is again composed of an outer mounting plate 112*a* and a link holder 112*b* to be inserted into it from one end, lateral projections 152 on the link holder 112*b* being introduced for this purpose into grooves 150 which begin at the open end 113*a* of the recess 113. Unlike hinge 10, however, the grooves 150 in hinge 110 extend over a greater length in the sidewalls of the recess 113, and the projections 152, which in this case are of elongated shape, are made of a corresponding length. Therefore it is not possible to raise up the link holder 112*b* and fix it in the mounting plate 112*a* by means of a matingly overlapping lip. The cap mounting projection 138 therefore is not divided, but is cast integrally with the link holder. The cap mounting projection has a tap 160 extending from top to bottom (FIG. 15), into which the screw 162 (FIG. 12) can be driven. In the bottom area of the mounting plate 112*a* which is opposite the tap in the properly installed state, there is provided a recess 164 (FIG. 14) which is circular in plan, and into which the bottom end of the mounting screw, when fully driven, enters and thus secures the link holder against withdrawal from the mounting part.

The top of the cap 136 is provided with a through bore 166 which is in line with the tap in the cap mounting projection 138, and accommodates the head of the mounting screw 162 when the latter is fully driven in. The head of the screw, therefore, is accessible for engagement by a screwdriver with the cap in place, and at the same time the cap is secured against withdrawal from the cap mounting projection 138. Whenever it is unnecessary or undesirable that the cap be secured on the cap mounting projection by a screw, a counterbore can be provided in the mounting plate projection 138 to accommodate the head of the screw when it is driven all the way in. The cap is then no longer secured by the head of the screw, i.e., the cap is easily withdrawn from the cap mounting projection. If, for example, a relatively narrow and therefore light mirrored cabinet door is mounted to the cabinet carcass with two hinges 110, the closing force of just one tongue 134 will suffice, and the cap 136 can be removed from the other hinge in the simple and rapid manner described.

I claim:

1. Over-center hinge for relatively thin doors of cabinets, especially of bathroom mirrored cabinets, comprising: a relatively thin door-related part adapted to be fastened, in a mating recess provided on the inside of the door facing the cabinet and open at the door edge, said door-related hinge part being divided into an outer mounting plate adapted to be fastened in said recess and which mounting plate is likewise open at the end adjacent the open door edge, and a separate link holder adapted to be inserted into said mounting plate from the open edge, said link holder being articulately joined to a supporting arm fastenable to a supporting wall of the cabinet, said hinge having a projection extending from the inside of the door, a molded cap removably fastened to said projection, said cap carrying a tongue extending into the path of a contact surface provided on the supporting arm and resiliently compressible by said contact surface, and on which tongue the contact surface slides during a part of the closing movement of the hinge through a dead center position, on one side of which dead center position the tongue exercises on the supporting arm through the contact surface a force acting in the hinge-open direction, and on the other side of which said tongue exercises a force in the hinge-closed direction, said link holder having lateral projections engaging in grooves of the mounting plate which extend in inserting direction and open in the open end of the mounting plate, and fastening means for securing, in a form-locking manner, the link holder in proper installed position against withdrawal from the mounting plate against the insertion direction.

2. An over-center hinge according to claim 1, in which said molded cap is constructed so as to be adapted to be pushed matingly, in the direction of the deformation of the tongue, onto the cap mounting projection of the door-related hinge part, and to be removed from it in the opposite direction, said cap mounting projection having a T-shaped cross section in a plane at right angles to the direction of installation of the molded cap, and said molded cap having a complementary T-shaped recess opening at least at one side and at the bottom thereof, said fastening means having a fastening element provided on one of said link holder or mounting plate, said fastening element being adapted to be brought into form-locking engagement with the other of said mounting plate or link holder.

3. An over-center hinge according to claim 2, wherein said fastening element is a lip.

4. An over-center hinge according to claim 2, wherein said fastening element is a fastening screw.

5. An over-center hinge according to claim 2, wherein said mounting projection is formed of two projection parts which, when the link holder is in said proper installed position in the mounting part, constitute the cap mounting projection, one of them being fixedly joined to the mounting plate and the other fixedly joined to the link holder, and wherein on one of said projection parts the fastening means is provided in the form of a lip which, in said proper installed position, engages a rebate on the other projection part.

6. An over-center hinge according to claim 5, wherein said projection part disposed on said link holder has a section overlapping the projection part disposed on said mounting plate in the insertion direction, said lip engaging said rebate disposed in the projection part of the mounting plate being provided on the underside of said section.

7. An over-center hinge according to claim 5 or 6, wherein said grooves in said mounting plate which receive the projections of said link holder extend only a short distance toward the interior of the mounting plate from the open end of the mounting plate, and wherein the projections of the link holder are so shaped that they permit the end of the link holder remote from the projections to be raised by the amount of the thickness of the lip.

8. An over-center hinge according to claim 2, wherein said cap mounting projection is disposed on the link holder and has a bore passing through from its top to the bottom, a screw forming said fastening means introduced into said bore, the threaded length of said screw being such that its free forward end, in the fully introduced state, projects from the bottom of the link holder, and a recess in the area of the mounting plate opposite said bore of the link holder into which the forward end of the screw protruding from the bottom of the link holder matingly engages.

9. An over-center hinge according to claim 8, wherein said through bore in the cap mounting projection is provided with a female thread complementary to the thread of the shank of the screw.

10. An over-center hinge according to claim 8, wherein the through bore in the cap mounting projection is a smooth-walled through bore, and wherein the recess in the mounting plate is provided with a female thread complementary to the thread of the shank of the screw.

11. An over-center hinge according to any one of claims 8 to 10, wherein the bore in the cap mounting projection has on its top a countersink to accommodate the head of the screw.

12. An over-center hinge according to any one of claims 8 to 10, wherein the molded cap has another through bore in alignment with the through bore in the cap mounting projection, the diameter of said another bore being at least equal to the diameter of the head of the screw.

* * * * *